US006364221B1

(12) United States Patent
Czimmek

(10) Patent No.: US 6,364,221 B1
(45) Date of Patent: Apr. 2, 2002

(54) ELECTRONIC FUEL INJECTOR ACTUATED BY MAGNETOSTRICTIVE TRANSDUCTION

(75) Inventor: Perry Robert Czimmek, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/608,191

(22) Filed: Jun. 30, 2000

Related U.S. Application Data

(60) Provisional application No. 60/156,559, filed on Sep. 29, 1999.

(51) Int. Cl.[7] ..... B05B 1/30; F02M 51/00; F02M 45/00; F02D 1/06

(52) U.S. Cl. ..... 239/585.1; 239/585.4; 239/585.5; 239/5; 239/533.4

(58) Field of Search ..... 239/585.1, 585.2, 239/585.3, 585.4, 585.5, 102.2, 533.7, 533.9, 5, 533.4, 533.2; 251/129.06

(56) References Cited

U.S. PATENT DOCUMENTS 2,721,100 A * 10/1955 Bodine, Jr. ..... 299/25
3,778,772 A * 12/1973 Rhodes ..... 340/163
4,804,314 A 2/1989 Cusack
5,004,945 A * 4/1991 Tomita et al. ..... 310/328
5,280,773 A 1/1994 Henkel
5,335,861 A * 8/1994 Matusaka ..... 239/533.12
5,479,902 A * 1/1996 Wirbeleit et al. ..... 123/498
5,593,095 A * 1/1997 Davis et al. ..... 239/533.12
5,819,704 A * 10/1998 Tarr et al. ..... 123/467
5,979,803 A * 11/1999 Peters et al. ..... 239/533.4
6,003,836 A 12/1999 Cewers
6,026,847 A 2/2000 Reinicke et al.

* cited by examiner

*Primary Examiner*—David A. Scherbel
*Assistant Examiner*—Davis Hwu

(57) ABSTRACT

An improved method of actuating an electronic fuel injector is provided using magnetostrictive transduction. A ferro-magnetic rod having giant magnetostrictive properties is operatively coupled with a fuel injector needle valve. Application of a magnetic field to the ferro-magnetic rod generates strain in the rod and corresponding motion in the needle valve, thereby actuating the fuel injector.

26 Claims, 8 Drawing Sheets

ELECTRONIC FUEL INJECTOR ACTUATED BY MAGNETOSTRICTIVE TRANSDUCTION

This application claims the benefit of U.S. Provisional Application No. 60/156,559 filed Sep. 29, 1999, which is hereby incorporated by reference in its entirety.

FIELD OF THE INVENTION

This invention relates to a high-speed electromagnetic actuator, and particularly to a fuel injector for an internal combustion engine. More particularly, this disclosure relates to an apparatus and method of actuating a fuel injector or similar metering device by magnetostrictive transduction.

BACKGROUND OF THE INVENTION

A conventional method of actuating a fuel injector is by use of an electromagnetic solenoid arrangement. A solenoid is an insulated conducting wire wound to form a tight helical coil. When current passes through the wire, a magnetic field is generated within the coil in a direction parallel to the axis of the coil. When the coil is energized, the resulting magnetic field exerts a force on a moveable ferromagnetic armature located within the coil, thereby causing the armature to move a needle valve into an open position in opposition to a force generated by a return spring. The force exerted on the armature is proportional to the strength of the magnetic field; the strength of the magnetic field depends on the number of turns of the coil and the amount of current passing through the coil.

In the conventional fuel injector, the point at which the armature, and therefore the needle, begins to move varies primarily with the spring preload holding the injector closed, the friction and inertia of the needle, fuel pressure, eddy currents in the magnetic materials, and the magnetic characteristics of the design, e.g., the ability to direct flux into the working gap. Generally, the armature will not move until the magnetic force builds to a level high enough to overcome the opposing forces. Likewise, the needle will not return to a closed position until the magnetic force decays to a low enough level for the closing spring to overcome the fuel flow pressure and needle inertia. In a conventional injector design, once the needle begins opening or closing, it may continue to accelerate until it impacts with its respective end-stop, creating wear in the needle valve seat, needle bounce, and unwanted vibrations and noise problems. Accordingly, a need exists for an improved fuel injector actuation method that will provide reduced noise, longer seat life, elimination of bounce, and full actuator force applied during the entire armature stroke, where the force is large as compared with the force resulting from fuel pressure effects.

A second less conventional method of actuating a fuel injector is by use of a piezoelectric actuator consisting of a stack of piezoceramic or piezocrystal wafers bonded together to form a piezostack transducer. Transducers convert energy from one form to another and the act of conversion is referred to as transduction. Piezoelectric transducers convert energy in an electric field into a mechanical strain in the piezoelectric material. The piezostack may be attached to the mechanical member or needle performing a similar function as the needle in the conventional injector. When the piezostack has a high voltage potential applied across the wafers, the piezoelectric effect causes the stack to change dimension, thereby opening the fuel injector. An advantage of piezoelectric actuation is that the ultrasonic operation results in improved fuel atomization. Another advantage of piezoelectric actuation is that the piezostack applies full force during the armature travel, allowing for controlled trajectory operation.

However, as can be observed from the following derivation, because the magnetic energy density is several orders of magnitude greater than the electric energy density, it is necessary to operate piezoelectric actuators at very high voltages, e.g. on the order of 200 volts. In addition, a piezoelectric actuator requires a complex high voltage driver with the capacity to slew hundreds of volts rapidly into a capacitive load while maintaining high voltage isolation.

Comparing the energy densities in magnetic and electric fields, it can be shown that the energy density in a magnetic field is given by:

$B^2/2\mu$, where $\mu$=permeability of free space=$12.57\times10^{-7}$ Tm/A;

the energy density in an electric field is given by:

$\epsilon E^2/2$, where $\epsilon$=permittivity of free space=$8.85\times10^{-12}$ C/Nm$^2$; and thus the ratio of magnetic to electric energy densities=$B^2/\mu\epsilon E^2$.

Conservatively, the magnetic energy density is several orders of magnitude greater than the electric energy density, given that most ferromagnetic materials saturate above 1Tesla (usually around 2 Tesla) and most dielectrics break down at above 100,000 Volts per mm (usually higher).

Accordingly, because magnetic energy density is several orders of magnitude greater than the electric energy density, piezoelectric (i.e., electrostrictive) transduction requires high voltages to generate a useful electric energy density and hence a useful strain in the piezoelectric material. Thus, a need exists for a fuel injector capable of operating on the magnetic equivalent of the piezoelectric effect, i.e., magnetostriction.

The term "magnetostriction" literally means magnetic contraction, but is generally understood to encompass the following similar effects associated with ferromagnetic materials: the Guillemin Effect, which is the tendency of a bent ferromagnetic rod to straighten in a longitudinal magnetic field; the Wiedemann Effect, which is the twisting of a rod carrying an electric current when placed in a magnetic field; the Joule Effect, which is a gradual increasing of length of a ferromagnetic rod when subjected to a gradual increasing longitudinal magnetic field; and the Villari Effect, which is a change of magnetic induction in the presence of a longitudinal magnetic field (Inverse Joule Effect).

The dimensional changes that occur when a ferromagnetic material is placed in a magnetic field are normally considered undesirable effects because of the need for dimensional stability in precision electromagnetic devices. Therefore, manufacturers of ferromagnetic alloys often formulate their alloys to exhibit very low magnetostriction effects. All ferromagnetic materials exhibit magnetic characteristics because of their ability to align magnetic domains. As shown in FIG. 1, strongly magnetostrictive materials characteristically have domains that are longer in the direction of their polarization (North/South) and narrower in a direction perpendicular to their polarization, thus allowing the domains to change the major dimensions of the ferromagnetic material when the domains rotate.

For example, the magnetostrictive alloy Terfenol-D ($Tb_{0.3}Dy_{0.7}Fe_{1.9}$), is capable of approximately 10 $\mu$m displacements for every 1 cm of length exposed to an approximately 500 Oersted magnetizing field. The general equation for magnetizing force, H, in Ampere-Turns per meter (1 Oersted=79.6 AT/m) is:

H=IN/L, where I=Amperes of current; N=number of turns; and L=path length.

Terfenol-D is often referred to as a "smart material" because of its ability to respond to its environment and exhibit giant magnetostrictive properties. The present invention will be described primarily with reference to Terfenol-D as a preferred magnetostrictive material. However, it will be appreciated by those skilled in the art that other alloys having similar magnetostrictive properties may be substituted and are included within the scope of the present invention.

SUMMARY OF THE INVENTION

A magnetostrictively actuated fuel injector is provided. The fuel injector has a body having a cavity along the longitudinal axis, an inlet port, an outlet port having a valve seat and a fuel passageway extending from the inlet port to the outlet port. A magnetostrictive element having a predetermined length is disposed in the cavity and is in operative contact with a needle having a tip proximate the valve seat forming a valve. A coil is provided for generating a magnetic field. The coil is disposed proximate the magnetostrictive element such that magnetic flux passes through the magnetostrictive element upon excitation of the coil, causing the predetermined length to increase, thereby actuating the valve

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

The presently preferred embodiments overcome many of the limitations of conventional electromechanical fuel injectors and piezoelectric-actuated fuel injectors described above by providing a magnetostrictive material that enables precise control of fuel through the metering valve by converting magnetic energy into mechanical energy by the use of a material with giant magnetostrictive properties. Magnetostrictive actuation is especially advantageous in high pressure direct fuel injection applications because the high force of the magnetostrictive actuator easily overcomes the fuel pressure force.

The presently preferred embodiments will be described primarily in relation to magnetostrictive fuel injectors. However, as will be appreciated by those skilled in the art, these embodiments are not so limited and may be applied to any type of actuator including, for example, electronic valve timing actuators and fuel pressure regulators.

In accordance with a preferred embodiment, the primary design parameters requiring consideration in incorporating magnetic transduction for actuating a fuel injector include selection of the magnetostrictive material, its quality, geometry, initial domain alignment in relation to magnetizing field direction, and desired magnitude of displacement and displacement direction. Terfenol-D is available in varying grades of quality and with different initial domain orientations. In a preferred embodiment, the domain polarity is oriented to allow for a positive longitudinal magnetic field to provide maximum strains in a longitudinal direction, thus lengthening the magnetostrictive member.

The prestress, as well as its direction in relation to domain orientation, may also be considered. Some prestress opposing the direction of the desired displacement of the magnetostrictive member is preferred. This is because a slight compression by a disk or coil spring results in greater needle displacement when the magnetizing force is applied. Of course, the prestress should not be so great as to prevent the displacement of the magnetostrictive material.

Magnetostrictive strain and prestress should be considered in selecting the geometry of the magnetostrictive member so as to avoid surpassing the yield stress of the material. For Terfenol-D, a compressive prestress increases the total strain capability of the material by more than the initial compressive strain. Terfenol-D has a tensile strength of less than 30 MPa and a compressive strength of greater than 600 MPa.

Figure 1:
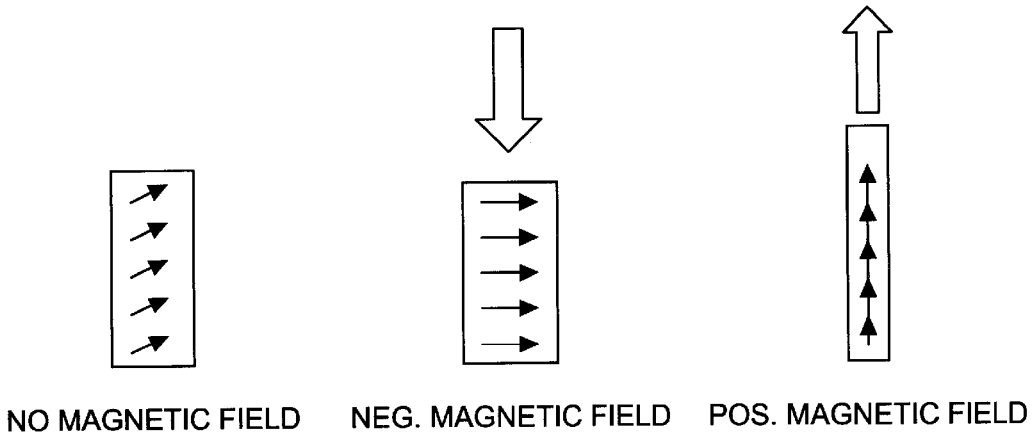
FIG. 1 is a sectional view of a magnetostrictive material illustrating the effect of an externally applied magnetic field on the orientation of magnetic domains within the material, and the corresponding effect on the outer dimensions of the material.
Figure 2:
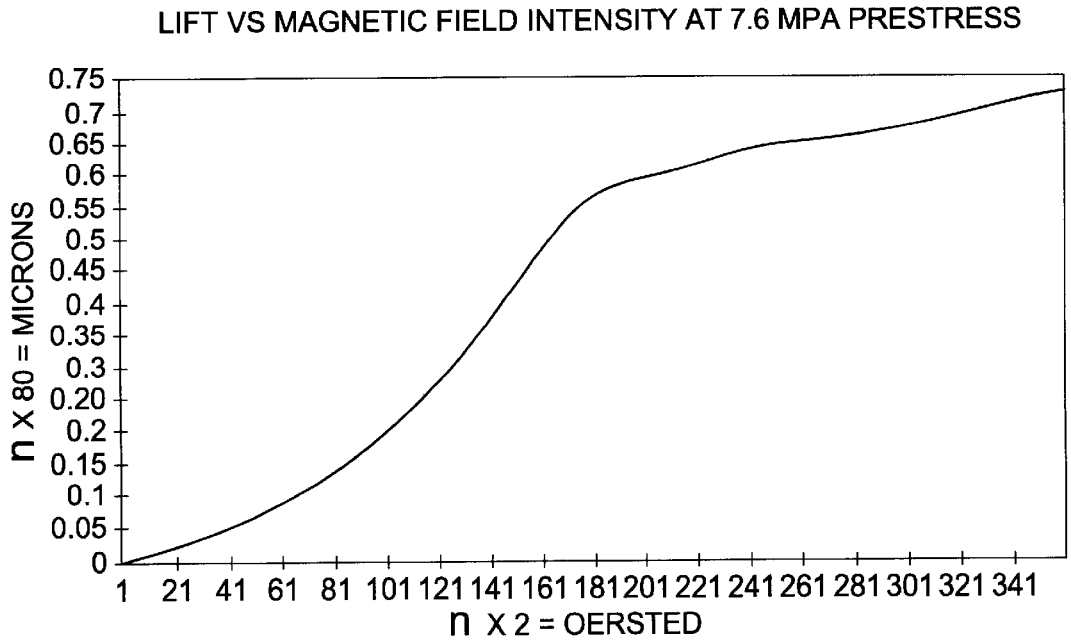
FIG. 2 illustrates the relationship between lift and magnetic field intensity for a magnetostrictive rod under prestress in accordance with the principles of the present invention.
Figure 3:
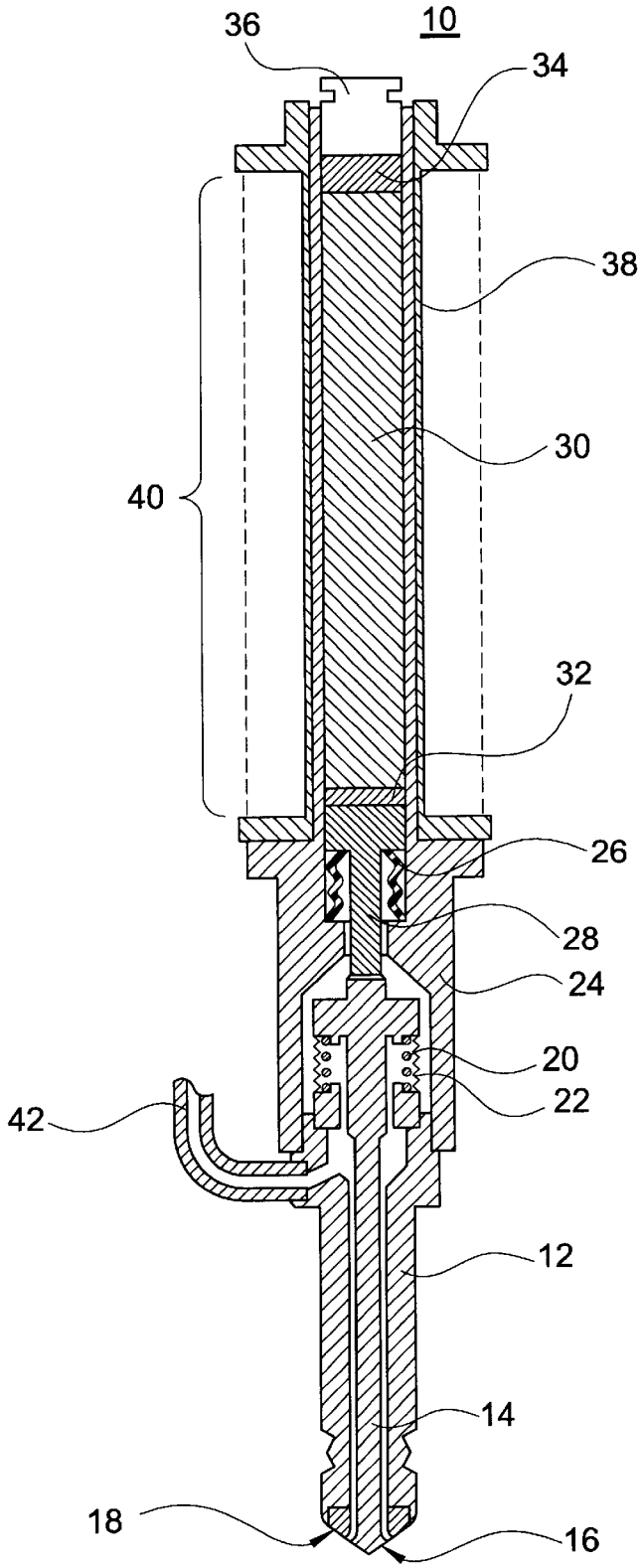
FIG. 3 is sectional view of a magnetostrictive fuel injector in accordance with a preferred embodiment of the present invention.
Figure 4:
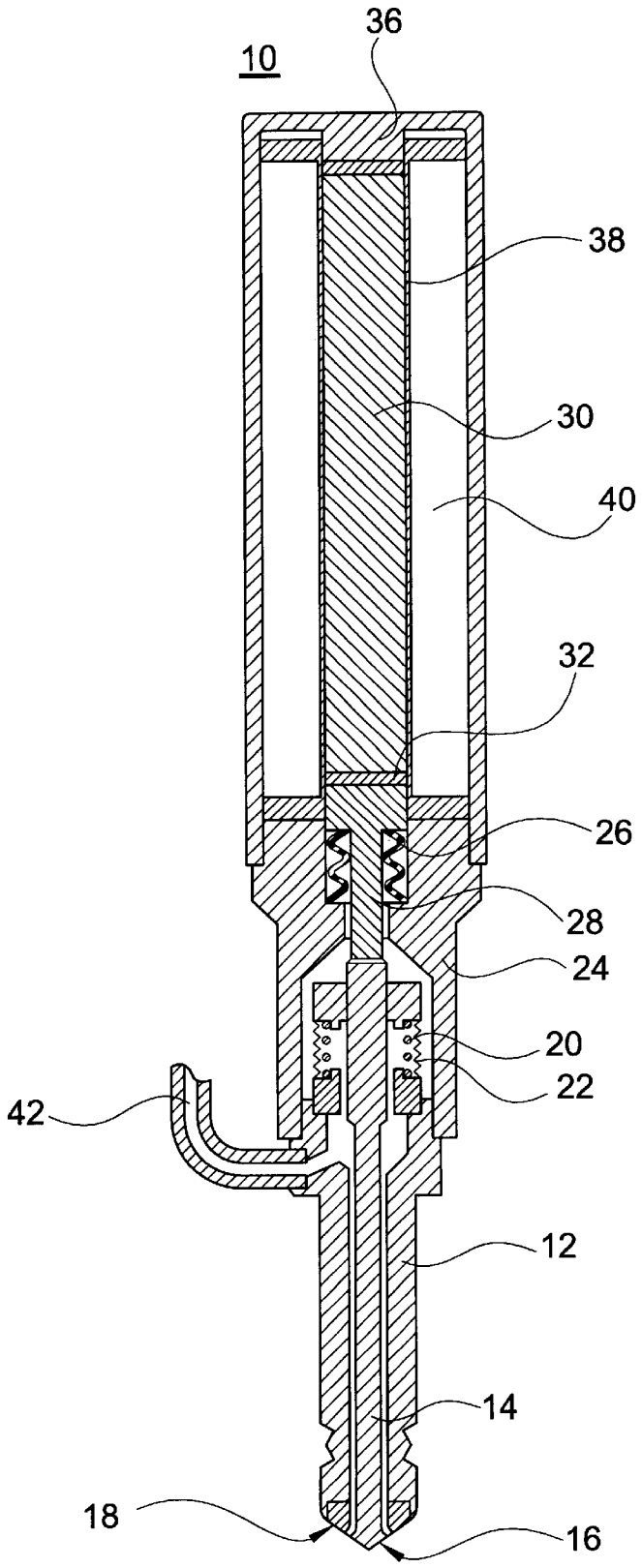
FIG. 4 is sectional view of a magnetostrictive fuel injector in accordance with a preferred embodiment of the present invention.
Figure 5:
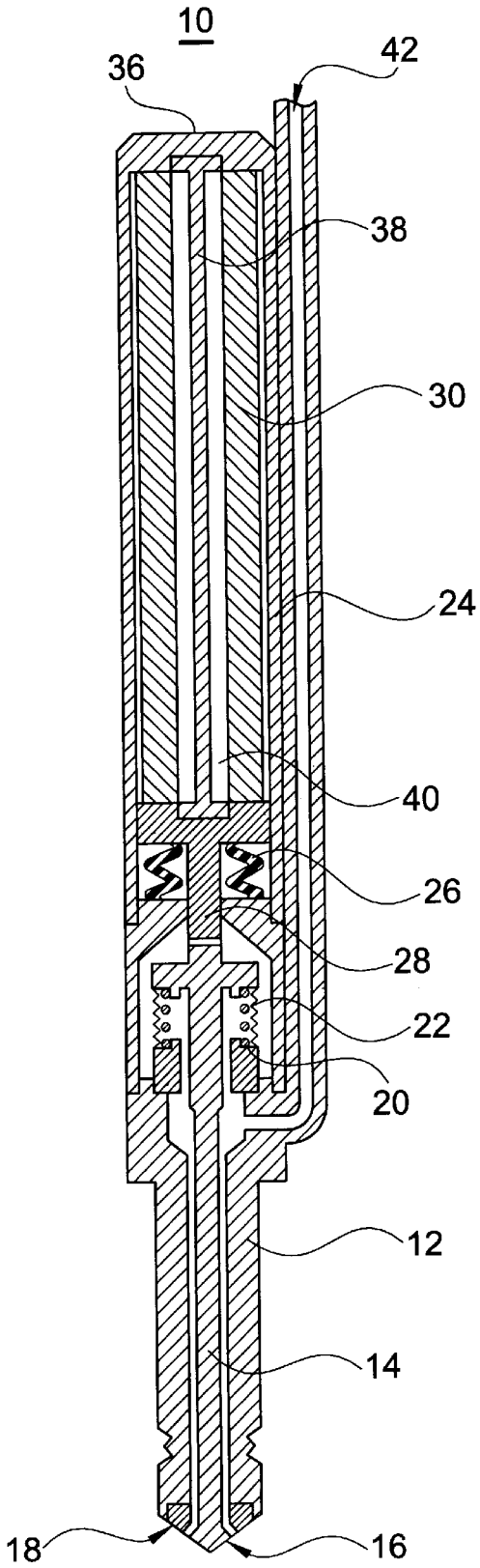
FIG. 5 is sectional view of a magnetostrictive fuel injector in accordance with a preferred embodiment of the present invention.

FIG. 2 illustrates lift versus magnetic field intensity experimental results achieved with a magnetostrictive transducer constructed from a Terfenol-D rod at 7.6 MPa prestress with an 8.0 mm outer diameter, a 3.5 mm inside diameter axial hole and a length of 50.0 mm.

FIGS. 3–8 illustrate fuel injectors in accordance with presently preferred embodiments. Referring to FIGS. 2–5, which illustrate high pressure direct injection fuel injectors 10 in accordance with presently preferred embodiments, the fuel injectors 10 comprise a valve body 12, preferably stainless steel, an injector needle 14 having a needle tip 16 forming a valve in conjunction with the injector seat 18. A closing spring 20 is operatively disposed to urge the needle tip 16 into a sealing position with the injector seat 18. A bellows 22, preferably metal, is disposed around the closing spring 20 to prevent fuel from entering the preferably non-magnetic upper portion 24 of the injector housing. A disk spring stack 26 exerts a force on a moving plunger 28, which is coaxially aligned with the injector needle 14 and a magnetostrictive member 30. Soft steel spacers 32 and 34 are positioned at both ends of the magnetostrictive member 30 between the moving plunger 28 and the end cap 36. A fuel inlet 42 is operatively connected to the valve body 14. The magnetostrictive member 30 is coaxially arranged with a coil bobbin 38 having a coil winding 40. In the preferred embodiments depicted in FIGS. 3 & 4, the magnetostrictive member 30 is located within the coil bobbin 38. In the preferred embodiment depicted in FIG. 5, the coil bobbin 38 is located within the magnetostrictive member 30.

In a preferred embodiment, the coil winding 40 may consist of about 750 turns of #24 AWG wire in eight layers and having a resistance of about 2.4 ohms, an inductance of about 2.5 mH, and a lift current of about 3 A. In an alternative preferred embodiment, the coil winding 40 may consist of about 1056 turns of #30 AWG wire in six layers and having a resistance of about 3.0 ohms, and a lift current of about 2 A.

In a preferred embodiment, the actuation of the injector can be in the form of an outward opening injector needle or an inward opening injector needle. The magnetostrictive member can be in the shape of a pillar pushing the injector open (in the case of an outward opening injector) or pulling the injector open (in the case of an inward opening injector), depending also on magnetizing field direction and the original domain orientation of the magnetostrictive member.

Figure 6:
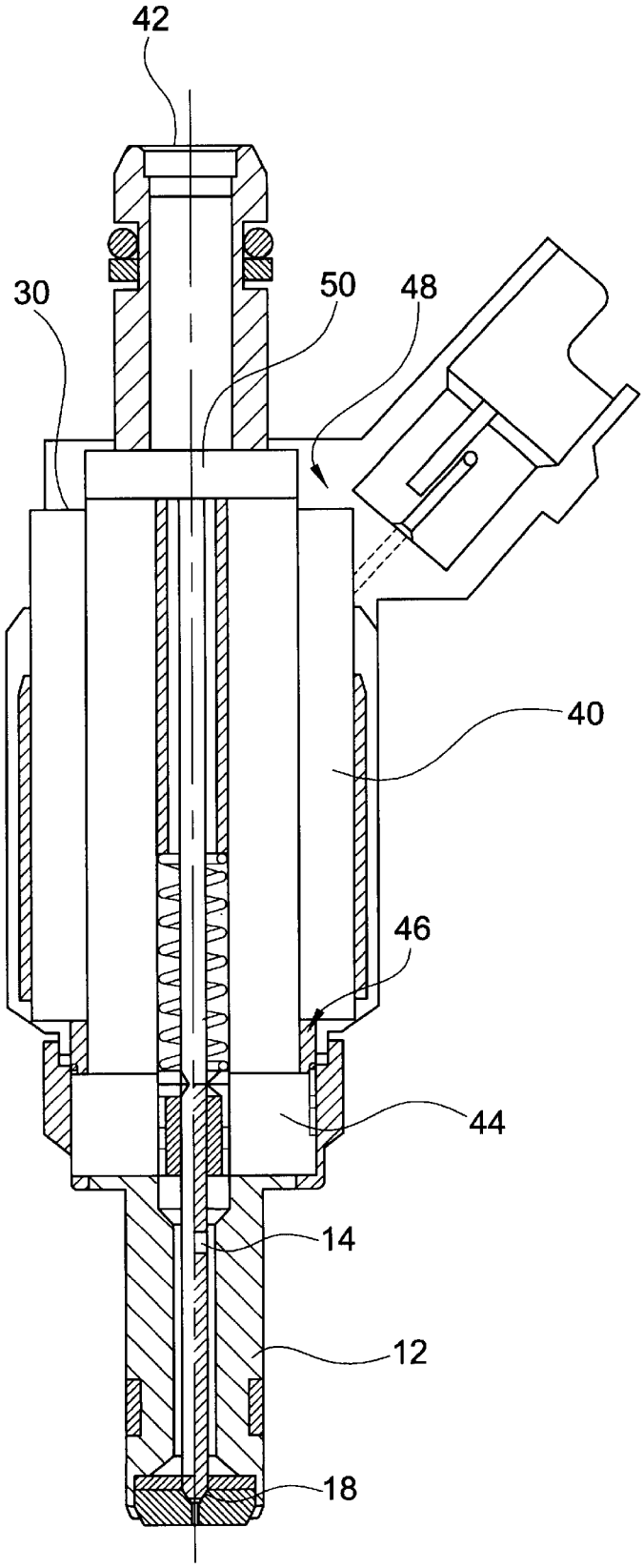
FIG. 6 is sectional view of a magnetostrictive fuel injector in accordance with a preferred embodiment of the present invention.

FIG. 6 depicts an inward opening direct injector in accordance with a preferred embodiment. In this embodiment, the injector needle 14 is attached to member 50, which is in operative contact with the moving end 48 of the magnetostrictive member 30. The non-moving end of the magnetostrictive member is positioned against a rigid mounting member 44 of the injector body 12. When the coil 40 is energized, a strain is produced in the magnetostrictive member 30 causing it to lengthen and open the needle valve 18.

Figure 7:
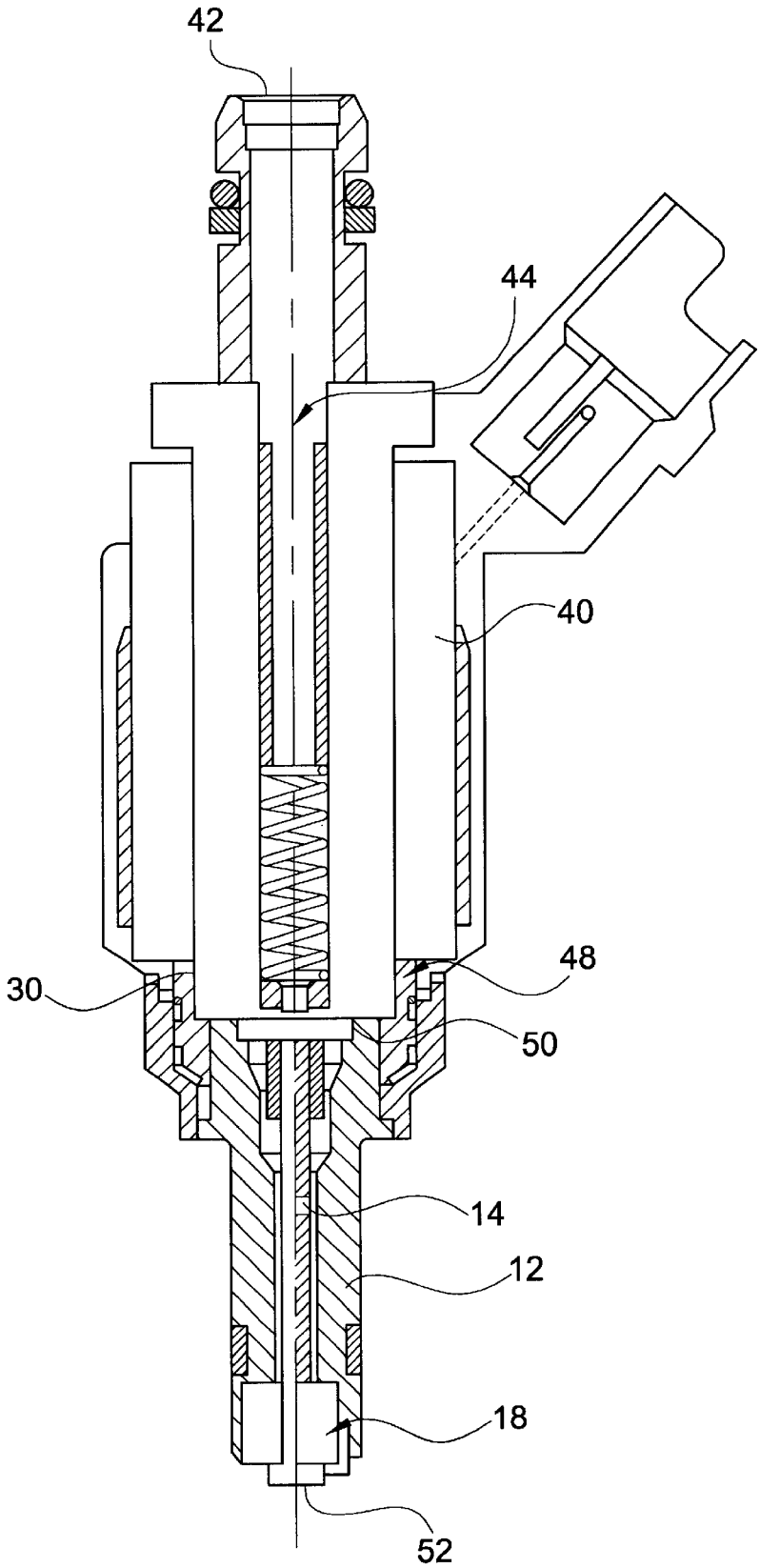
FIG. 7 is sectional view of a magnetostrictive fuel injector in accordance with a preferred embodiment of the present invention.

FIG. 7 depicts an outward opening injector in accordance with a preferred embodiment. In this embodiment, the injector needle 14 is attached to member 50, which is in contact with the moving end 48 of the magnetostrictive member 30. The non-moving end of the magnetostrictive member is positioned against a rigid mounting member 44 of the injector body 12. When the coil 40 is energized, a strain is produced in the magnetostrictive member 30 causing it to lengthen and open the outward opening pintle 52.

In a preferred embodiment, the magnetostrictive member can also be in the form of a tube or a group of pillars, incorporating a push/pull strategy described above, but with the advantage of having the needle inside the member to reduce injector dimensions. A tubular member also has the advantage of allowing fuel to flow through the pillar and/or around the pillar to facilitate fuel flow and to provide cooling for the magnetic circuit and solenoid.

The following design example is provided in accordance with a preferred embodiment. Assuming a desired injector lift of 45 microns, based on a 1 part in 1000 strain of a properly installed magnetostrictive member (Terfenol-D) and 0.25 cm from each end of the member lost out of the magnetic circuit due to assembly requirements, the length of the member will be 5 cm. The diameter is 8 mm with a 3 mm axial hole for passage of the needle and fuel. With a 1000 turn coil wound along 4.5 cm of the length of the member, a current of about 4.2 amperes will be necessary to drive the member from its closed injector length to its open injector length. The displacement will follow a trajectory proportional to: $I_{max}=V/R$, $t_{63\%I}=L/R$ In accordance with a preferred embodiment, magnetostrictive transduction may be used in conjunction with a magnetostrictive member to form a hybrid fuel injector in which magnetostriction is used to assist in the opening or closing of a conventional electromagnetic fuel injector. For example, a magnetostrictive member may be used as a "kicker" to provide a small mechanical displacement (e.g., 5 to 10 microns) to assist in the opening of a high pressure direct injection fuel injector whose armature and needle are working against a large fuel back pressure, such as, for example, greater than 100 Bar. In such an arrangement, the burden of the injector's ordinary armature/stator working gap to have magnetic forces large enough to overcome the fuel backpressure would be lessened. In a preferred embodiment, the solenoid coil for the magnetostrictive portion of the injector could be in series with the conventional injector coil, and may include analog or digital logic incorporated into the injector or driver to gate current to the appropriate coil at the appropriate time interval during injector operation. In a preferred embodiment, consideration should be given to the magnetic architecture of the magnetostrictive portion of the hybrid injector to prevent the magnetic field of the magnetostrictive member from simply holding the armature in place, accomplishing just the opposite effect of "kicking" the armature away with mechanical movement.

Figure 8:
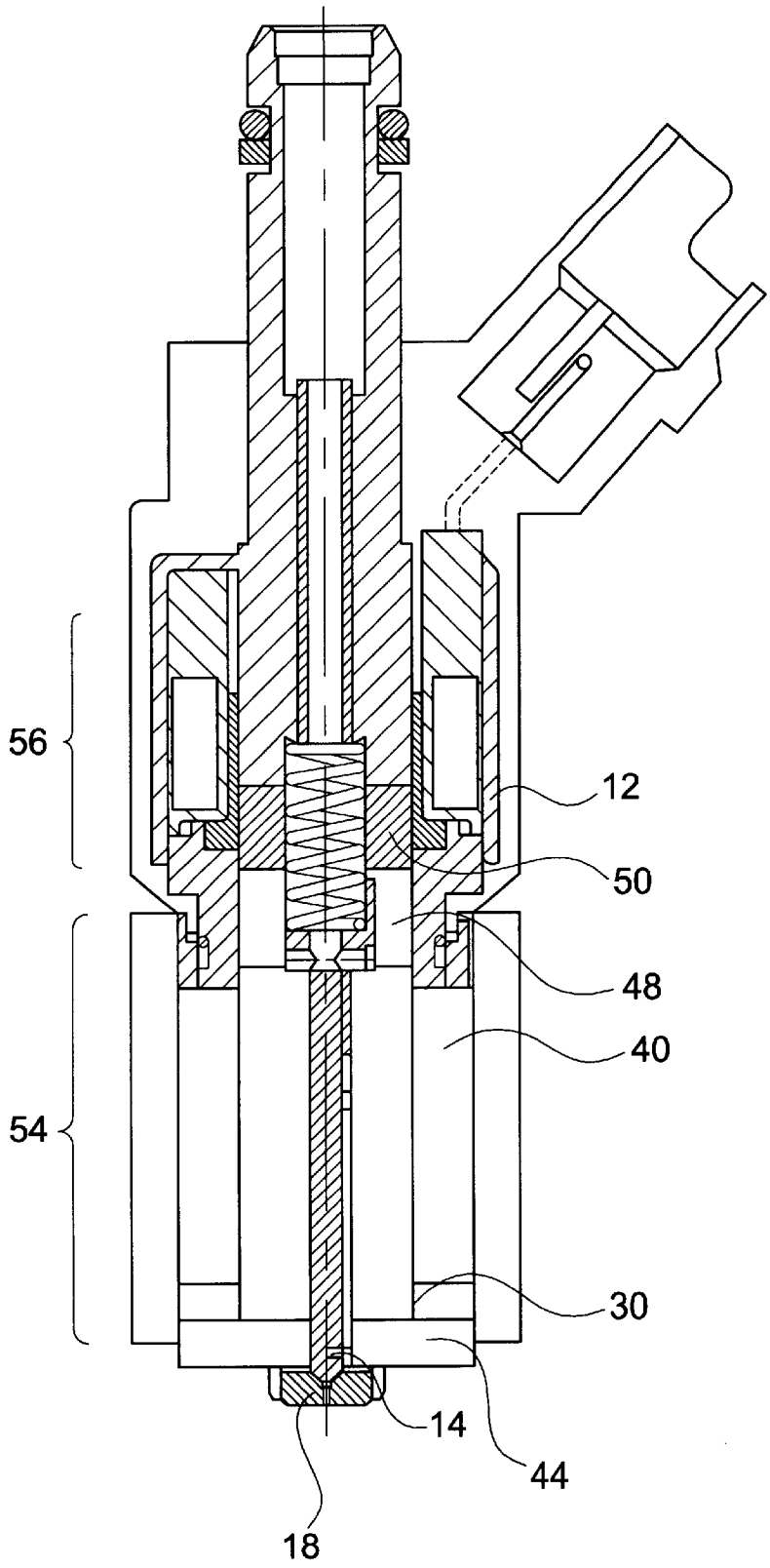
FIG. 8 is sectional view of a magnetostrictive hybrid file injector in accordance with a preferred embodiment of the present invention.

FIG. 8 depicts a hybrid fuel injector including a magnetostrictive portion 54 and a conventional electromagnetic solenoid portion 56 in accordance with a preferred embodiment. In this embodiment, the injector needle 14 is attached to member 50, which is in contact with the moving end 48 of the magnetostrictive member 30. The non-moving end of the magnetostrictive member is rigidly positioned against a rigid mounting member 44 of the injector body 12. When the coil 40 is energized, a strain is produced in the magnetostrictive member 30 causing it to lengthen and open the valve 18. The conventional electromagnetic solenoid portion 56 includes a solenoid, armature and stator in a conventional arrangement.

In a preferred embodiment, a closing spring places an outward opening injector needle in a state of tension, producing a strain displacement in the direction of the tension. Likewise, a closing spring places an inward opening injector needle in a state of compression, producing a strain displacement in the direction of the compression. The resulting strain caused by the closing spring force is often an undesirable effect that should be accounted for in most fuel injector designs. However, in a preferred embodiment, this strain (i.e., the needle's modulus of elasticity) will be used advantageously as a high rate spring by dimensioning, hardening and/or annealing the needle in such a way as to limit the resulting strain to a particular range. In the case of an inward opening injector, the needle may be utilized as a compression spring. In the case of an outward opening injector, the needle may be utilized as a tension spring. Using the injector needle as a high rate spring has the advantageous effect of allowing optimization of thermal and tolerance compensation of the needle and of the direct actuating magnetostrictive member and valve body. For example, the strain displacement of such a needle could be on the order of 10 to 15 microns in an injector with a desired lift of approximately 40 to 50 microns.

Figure 9:
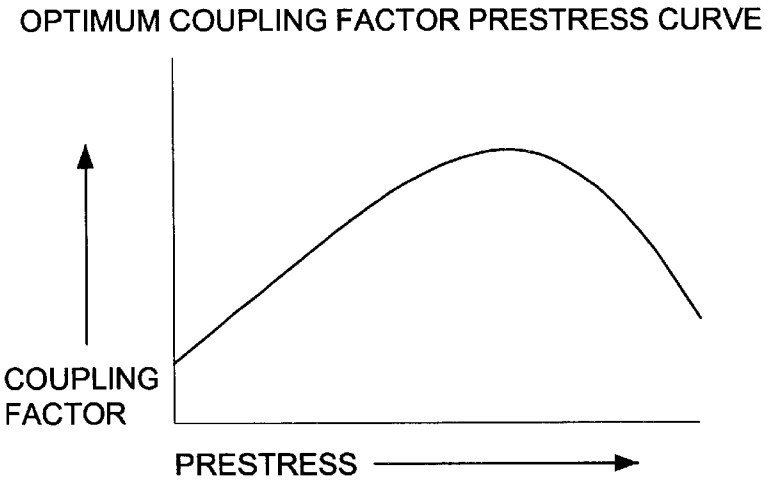
FIG. 9 illustrates the relationship between the coupling factor and the prestress of a magnetostrictive member in accordance with the present invention.

To take advantage of the needle as a spring in what may be termed "spring-lash," it should be noted that in a preferred embodiment the magnetostrictive material may operate in a state of prestress for optimum displacement with a given magnetic field. Prestress affects the coupling factor, which is a transductive characteristic of the magnetostrictive material. FIG. 9 depicts an optimum coupling factor prestress curve. The coupling factor determines what may be termed the magnetomechanical coupling, or the coupling between the magnetic force and the member subjected to the mechanical force. An ideal coupling factor of 1 would result in all the magnetic force being transduced into mechanical force. The coupling factor for Terfenol-D is usually in the range of 0.72 to 0.75. The greater the coupling factor, the greater the resulting strain for a given magnetization force. The coupling factor is a highly non-linear variable and is non-monotonic when changing due to different compressive prestresses on a magnetostrictive member. There is an optimum prestress for a given magnetostrictive member, which will achieve the maximum coupling factor.

In a preferred embodiment, the magnetostrictive member is lightly prestressed in compression against the closing spring and needle (e.g., 5 to 10 percent of optimum coupling prestress), such that as the magnetostrictive member begins straining when a magnetization force is applied, the magnetostrictive member will work against the closing spring force. As the magnetostrictive member begins working against the closing spring force, it will first increase in its compressive prestress causing the coupling factor to begin increasing. Simultaneously, the spring lash, in the form of strain displacement of the needle length, will be taken out until the spring lash is gone and the needle is no longer stressed. Once the magnetostrictive displacement has taken out the needle strain, the magnetostrictive member will see all of the closing spring force. The closing spring force should be selected to place the magnetostrictive member close to its optimum compressive prestress range for an optimum coupling factor.

Figure 10:
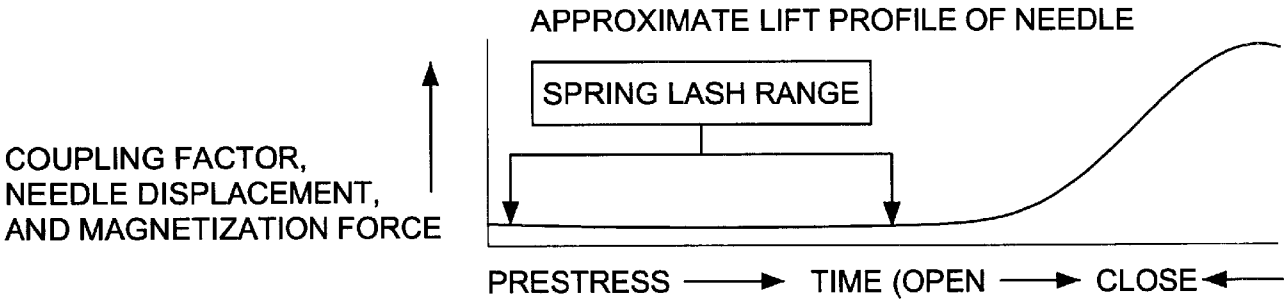
FIG. 10 illustrates a lift profile of a needle valve having spring lash in accordance with a preferred embodiment of the present invention.

At the point where all of the needle strain is removed, further strain displacement of the magnetostrictive member will result in displacement of the needle off its seat and the magnetostrictive member will be operating in its optimum prestress range and will therefore provide the most displacement for a given magnetization force, prior to magnetic saturation. The magnetostrictive member will continue displacing until it reaches the desired needle lift. The maximum needle lift may be determined by the maximum magnetization force. Some needle spring lash is desirable in order to prevent injector leakage by ensuring the needle will close completely in the presence of tolerance stack up, thermal cycling, or to account for normal seat/needle wear. FIG. 10 depicts an exemplary lift profile of a needle having spring lash.

The magnetization force, and therefore needle lift, is determined primarily by the coil current and number of coil turns. The number of coil turns may be calculated or experimentally determined for a given design. The maximum level of the coil current may be varied to adjust lift. The coil current should be maintained within a reasonable range that would avoid saturating the magnetostrictive material or dissipating excessive power in the coil. In a preferred embodiment, the current can be varied by an external driver or determined by the operating voltage and coil resistance.

In a preferred embodiment, a transistor current regulator, preferably of the switchmode variety, may be incorporated inside the injector. A linear mode current regulator may also be used but may dissipate too much power as heat to be practical. In a preferred design, the current regulator may be housed inside the injector and provided with electrical power and a logic signal for controlling the injector. The design may include a three pin injector electrical connection consisting of an electrical power source pin, a signal/supply common pin and a signal input pin. The current regulator may include resistors trimmed in production to set the lift of the injector by setting the current regulation level.

The switching frequency and amplitude of the current regulator can be utilized for ultrasonic excitation and therefore ultrasonic metering and atomization of the fuel. The switching frequency may be selected by weighing five primary variables: (1) the needle amplitude (which affects spray droplet size via the actual needle displacement and the formation of standing waves in the spray); (2) the avoidance of cavitation at the metering orifice or inside the injector; (3) the power dissipation of the regulator; (4) the natural resonant frequency of the magnetostrictive member; and (5) the effect on the spray cone angle.

Terfenol-D, like all ferromagnetic materials, has a Curie temperature where fall demagnetization occurs. In the case of Terfenol-D, the Curie temperature is about 380 degrees Centigrade. In the temperature range from below zero degrees Centigrade to close to the Curie temperature, the magnetostrictive transduction decreases at a nearly linear rate. In a preferred embodiment, in order to compensate for degradation in needle lift as temperature increases, a temperature compensating component, such as a thermistor, may be incorporated in the current regulator to trim the current to higher values as the temperature increases. As the temperature rises, a desired needle lift may be maintained by increasing the current, and thus increasing the magnetization force to adjust for the decreased gain of the magnetostrictive transduction effect. In a preferred embodiment, careful selection of the thermistor resistance slope over the desired temperature range may result in a nearly perfect cancellation of the slope of magnetostrictive degradation due to temperature, thus enabling a constant lift to be maintained over the entire operating temperature range of the fuel injector. A similar thermistor trim may be used to compensate for lift changes due to dimensional changes in injector components caused by thermal variations.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but have the fall scope defined by the language of the following claims, and equivalents thereof.

What I claim is:

1. A fuel injector comprising:

a body having a cavity along the longitudinal axis, an inlet port, an outlet port having a valve seat and a fuel passageway extending from the inlet port to the outlet port;

a magnetostrictive element having a predetermined length disposed in the cavity;

a needle disposed within the body and having a tip proximate the valve seat forming a valve;

a biasing member disposed between the magnetostrictive element and the needle, the biasing member providing a pre-stress force on the magnetorestrictive element;

a coil for generating a magnetic field disposed proximate the magnetostrictive element such that magnetic flux passes through the magnetostrictive element upon excitation of the coil, causing the predetermined length to increase, thereby actuating the valve.

2. A fuel injector comprising:

a body having a cavity along the longitudinal axis, an inlet port, an outlet port having a valve seat and a fuel passageway extending from the inlet port to the outlet port;

a magnetostrictive element having a predetermined length disposed in the cavity;

a needle disposed within the body and having a tip proximate the valve seat forming a valve;

a biasing member disposed between the magnetostrictive element and the needle;

a coil for generating a magnetic field disposed proximate the magnetostrictive element such that magnetic flux passes through the magnetostrictive element upon excitation of the coil, causing the predetermined length to increase, thereby actuating the valve, wherein the biasing member comprises a spring means and a plunger operatively arranged to exert a predetermined prestress force on the magnetostrictive member.

3. The fuel injector of claim 2, wherein the magnetostrictive member is substantially concentrically disposed within the coil.

4. The fuel injector of claim 3, wherein the needle tip retracts inward toward the body of the injector as the predetermined length of the magnetostrictive element increases.

5. The fuel injector of claim 3, wherein the needle tip extends outward away from the body of the injector as the predetermined length of the magnetostrictive element increases.

6. The fuel injector of claim 2, wherein the coil is substantially concentrically disposed within the magnetostrictive member.

7. The fuel injector of claim 6, wherein the needle tip retracts inward toward the body of the injector as the predetermined length of the magnetostrictive element increases.

8. The fuel injector of claim 6, wherein the needle tip extends outward away from the body of the injector as the predetermined length of the magnetostrictive element increases.

9. The fuel injector of claim 2, further comprising a second spring means operatively arranged to exert a strain displacement on the needle such that the needle operates as a high rate spring.

10. The fuel injector of claim 9, wherein the strain displacement is in the range of approximately 10 to 15 microns.

11. The fuel injector of claim 2, further comprising:

a switchmode transistor current regulator housed within the injector housing for driving the coil.

12. The fuel injector of claim 11, further comprising trim resistors for calibrating the current regulation level in the coil.

13. A fuel injector comprising:

a body having a cavity along the longitudinal axis, an inlet port, an outlet port having a valve seat and a fuel passageway extending from the inlet port to the outlet port;

a magnetostrictive element having a predetermined length disposed in the cavity and being in operative contact with a needle having a tip proximate the valve seat forming a valve;

a first coil for generating a magnetic field disposed proximate the magnetostrictive element such that magnetic flux passes through the magnetostrictive element upon excitation of the coil, causing the predetermined length to increase, thereby initiating motion in the valve;

an armature substantially coaxially aligned with an operatively connected to the needle;

a second coil positioned substantially coaxially in relation to the armature such that a magnetic field generated by the second coil exerts a force on the armature when the second coil is energized, causing the armature to move from a first position to a second position, thereby urging the valve into an open position.

14. The fuel injector of claim 13, further comprising a spring means disposed in the body and operatively arranged to exert a predetermined prestress force on the magnetostrictive member.

15. The fuel injector of claim 14, wherein the magnetostrictive member is substantially concentrically disposed within the coil.

16. The fuel injector of claim 15, wherein the needle tip retracts inward toward the body of the injector as the predetermined length of the magnetostrictive element increases.

17. The fuel injector of claim 15, wherein the needle tip extends outward away from the body of the injector as the predetermined length of the magnetostrictive element increases.

18. The fuel injector of claim 14, wherein the coil is substantially concentrically disposed within the magnetostrictive member.

19. The fuel injector of claim 18, wherein the needle tip retracts inward toward the body of the injector as the predetermined length of the magnetostrictive element increases.

20. The fuel injector of claim 18, wherein the needle tip extends outward away from the body of the injector as the predetermined length of the magnetostrictive element increases.

21. The fuel injector of claim 14, further comprising a second spring means operatively arranged to exert a strain displacement on the needle such that the needle operates as a high rate spring.

22. The fuel injector of claim 21, wherein the strain displacement is in the range of approximately 10 to 15 microns.

23. The fuel injector of claim 14, further comprising:

a switchmode transistor current regulator housed within the injector housing for driving the coil.

24. The fuel injector of claim 23, further comprising trim resistors for calibrating the current regulation level in the coil.

25. A method of actuating a fuel injector, the method comprising:

providing a body having a cavity along the longitudinal axis, an inlet port, an outlet port having a valve seat and a fuel passageway extending from the inlet port to the outlet port;

providing a magnetostrictive element having a predetermined length disposed in the cavity and being in operative contact with a needle, the needle being disposed within the body and having a tip proximate the valve seat forming a valve;

locating a biasing member between the magnetostrictive element and the needle, the biasing member providing a pre-stress force on the magnetorestrictive element; and providing a coil for generating a magnetic field disposed proximate the magnetostrictive element such that magnetic flux passes through the magnetostrictive element upon excitation of the coil, causing the predetermined length to increase, thereby actuating the valve.

26. A method of actuating a fuel injector, the method comprising:

providing a body having a cavity along the longitudinal axis, an inlet port, an outlet port having a valve seat and a fuel passageway extending from the inlet port to the outlet port;

providing a magnetostrictive element having a predetermined length disposed in the cavity and being in operative contact with a needle, the needle being disposed within the body and having a tip proximate the valve seat forming a valve;

locating a biasing member between the magnetostrictive element and the needle;

providing a coil for generating a magnetic field disposed proximate the magnetostrictive element such that magnetic flux passes through the magnetostrictive element upon excitation of the coil, causing the predetermined length to increase, thereby actuating the valve;

providing an armature substantially coaxially aligned with an operatively connected to the needle; and providing a second coil positioned substantially coaxially in relation to the armature such that a magnetic field generated by the second coil exerts a force on the armature when the second coil is energized, causing the armature to move from a first position to a second position, thereby urging the valve into an open position.

* * * * *